United States Patent [19]

Welsh et al.

[11] 4,171,096

[45] Oct. 16, 1979

[54] SPRAY GUN NOZZLE ATTACHMENT

[75] Inventors: John Welsh, 1136 Linmar Dr., North Canton, Ohio 44720; John V. Havrilla, Cleveland; John W. Havrilla, Akron, both of Ohio

[73] Assignee: John Welsh, Akron, Ohio

[21] Appl. No.: 800,862

[22] Filed: May 26, 1977

[51] Int. Cl.[2] ..... B05B 1/28; B05B 7/00

[52] U.S. Cl. ..... 239/291; 239/301; 239/420; 239/424

[58] Field of Search ..... 239/290, 291, 296, 300, 239/301, 394, 419.5, 420, 421, 423, 424, 424.5, 425.5

[56] References Cited

U.S. PATENT DOCUMENTS

| | | | |
|---|---|---|---|
| 1,661,150 | 2/1928 | Birkenmaier | 239/300 X |
| 1,780,738 | 11/1930 | Beach | 239/300 |
| 1,860,129 | 5/1932 | Binks et al. | 239/300 |
| 2,438,471 | 3/1948 | Ball | 239/300 |
| 2,544,123 | 3/1951 | Andersson | 239/424.5 X |
| 2,814,530 | 11/1957 | Portillo | 239/296 |
| 3,829,026 | 8/1974 | Aghnides | 239/394 |

*Primary Examiner*—Johnny D. Cherry

*Attorney, Agent, or Firm*—Hamilton, Renner & Kenner

[57] ABSTRACT

A nozzle for a spray gun for depositing liquid on a work surface including a body having a channel communicating with a dispensing tip for the liquid, an assembly for attaching the body to the spray gun such that the liquid supplied from the spray gun is introduced into the channel of the body, a passage for the transmittal of pressurized air from the spray gun to a position proximate the dispensing tip, and an air cap circumposed about the dispensing tip having a plurality of orifices therein communicating with the passage for directing pressurized air jets axially of the air cap, whereby the liquid emitted from the dispensing tip is entrained within the confines of the pressurized air jets and deposited on the work surface.

11 Claims, 4 Drawing Figures

SPRAY GUN NOZZLE ATTACHMENT

BACKGROUND OF THE INVENTION

The present invention relates to apparatus for use with spray guns for dispensing paint or similar surface coating materials. More particularly, the present invention relates to a nozzle adapted for use with various existing spray gun configurations to produce a variety of different decorative surface coatings. More specifically, the invention relates to a spray gun nozzle configuration which permits the application of paint or other surface covering materials in a manner producing a variety of patterns which cannot be achieved with conventional spray gun nozzles.

The application of paints and other surface covering liquids such as lacquers, varnishes and shellacs by spray guns has long been a significant factor in high volume commercial painting and finishing facilities. The necessity for compressed air sources having the required characteristics and the sophistication of spray gun apparatus for producing acceptable results has limited paint and finishing material spraying operations generally to commercial applications. In recent years, however, numerous factors have contributed to a wider spread use of spray gun equipment outside commercial painting and finishing applications. A prime factor in this extended usage of spray gun apparatus is the relatively recent availability of air compressors having suitable performance characteristics at greatly reduced prices. In addition, spray guns having adequate performance characteristics for other than continual commercial usage are available from a variety of sources at a fraction of the price of conventional commercial units.

Most recent developments in the art have been directed toward providing spray guns having characteristics permitting the usage of a variety of different liquids by making the liquid to air ratios adjustable, by providing guns capable of operating with lower air pressure sources, and by providing a variety of nozzle and valve configurations adapted to provide operation with liquids having differing molecular, viscosity, and other characteristics. In some instances efforts have been made to provide flexibility with respect to dispensing different liquids by effecting size variations to existing internal mix and external mix nozzles, while in other instances, efforts have been made to provide spray guns which can be readily converted by providing a plurality of nozzles for both internal and external air-liquid mix operation. Other variations and combinations have been created to provide operation as bleeder type or nonbleeder type guns which may be provided with either pressure feed or syphon feed of the liquid to be dispensed.

The various types of spray guns have to applicant's knowledge endeavored to provide a fine spray coating of the liquid to be sprayed effecting uniform coverage over essentially the entire air jet pattern. Such spray guns have no capability for providing a decorative pattern other than total surface coverage. Further, existing spray guns of both the commercial and less sophisticated variations have continued to accept as a basic operating premise the tendency of the finely atomized paint and other surface covering liquids to drift via rebounding from a work surface or otherwise to proximate surfaces such that the usage of spray guns is effectively precluded where there are surfaces that cannot be the recipient of atomized paint particles, particularly in relation to drafty or outdoor usages where significant air currents can be encountered in the spraying area.

SUMMARY OF THE INVENTION

Therefore, an object of the present invention is to provide a nozzle for a spray gun which is capable of dispensing paint or other surface covering liquids in a plurality of decorative dispositions. Another object of the invention is to provide a nozzle for spray guns having adjustment features providing for optimized performance in effecting such a plurality of dispositions. A further object of the present invention is to provide a nozzle for dispensing paint or other surface covering liquids wherein the paint or other liquid has minimal tendencies to drift or rebound from a work surface by virtue of avoiding a fine atomization of the paint or other liquid as is characteristic of existing spray gun nozzles.

Still another object of the invention is to provide a nozzle for spray guns which is adapted for usage with a variety of conventional spray guns commercially available. A further object of the invention is to provide a nozzle having an external mix configuration wherein the paint or other surface covering liquid is dispensed from a tip located outwardly in the direction of the work surface relative to the air cap orifices from which the air jets carrying the liquid to the work surface are located. Yet another object of the invention is to provide a nozzle for spray guns having apertures for the liquid carrying air jets which are nonintersectingly aligned such that the liquid is transported in larger particulate form than is produced by the conventional turbulent intermixing of the intersecting air jet streams.

Still a further object of the invention is to provide a nozzle for an air gun wherein an annular curtain of air is provided about the liquid dispensing tip in combination with air jets formed by orifices in the air cap providing axially directed air jets emanating outwardly of the annular curtain and wherein the annular curtain of air may be selectively controlled by predetermined positioning of the air cap. Yet a still further object of the invention is to provide a nozzle which is easy to assemble and disassemble for cleaning purposes which is relatively noncomplex but which yields decorative dispositions of surface covering liquids beyond the capabilities of existing nozzle configurations.

In general, a nozzle for a spray gun for depositing liquid on a work surface embodying the concepts of the present invention has a body having a channel communicating with a dispensing tip for the liquid, an assembly for attaching the body to the spray gun such that the liquid supplied from the spray gun is introduced into the channel of the body, a passage for the transmittal of pressurized air from the spray gun to a position proximate the dispensing tip, and an air cap circumposed about the dispensing tip having a plurality of orifices therein communicating with the passage for directing pressurized air jets axially of the air cap, whereby the liquid emitted from the dispensing tip is entrained within the confines of the pressurized air jets and deposited on the work surface.

DESCRIPTION OF THE PREFERRED EMBODIMENT

Figure 1:
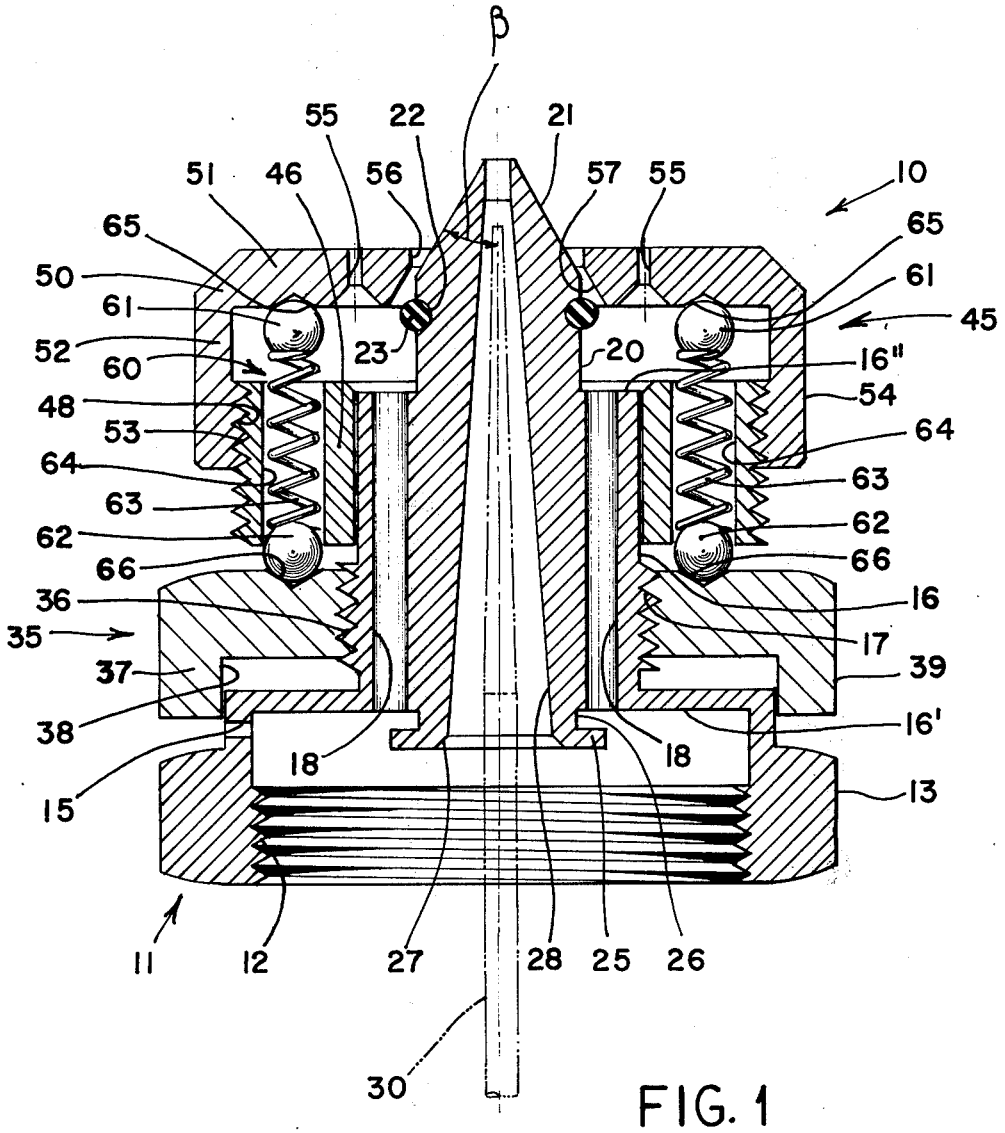
FIG. 1 is a longitudinal cross-sectional view of a nozzle for a spray gun embodying the concepts of the present invention with the components thereof assembled in operative manner for threading attachment to a conventional spray gun, a liquid control needle of a spray gun being depicted in chain lines.
Figure 2:
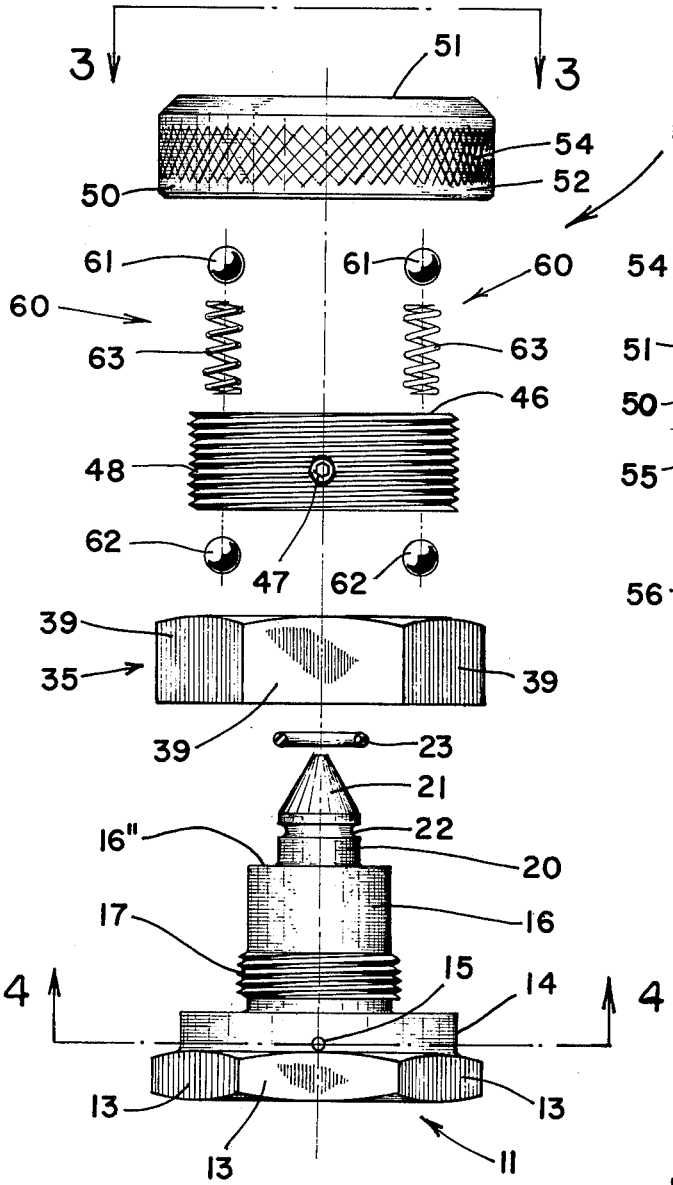
FIG. 2 is an exploded side elevational view of the nozzle of FIG. 1 depicting the individual components in disassembled array.

A nozzle for a spray gun embodying the concepts of the present invention, as generally indicated by the numeral 10 in FIGS. 1 and 2 of the attached drawings, is adapted for usage with a plurality of conventional spray guns. As seen by reference to FIGS. 1 and 2 of the drawings, the nozzle 10 has a body portion, generally indicated by the numeral 11, which may be of somewhat T-shaped configuration. The body portion 11 has at one axial extremity thereof an internally threaded bore 12 which is adapted to matingly engage nozzle attachment threads on the gun body assembly of a variety of conventional spray guns. The body portion 11 of nozzle 10 has for assisting in effecting sealing attachment to a spray gun a plurality of lands 13 formed externally of the body portion 11 preferably in the area of threaded bore 12 for purposes of creating a standard hexagonal or other head configuration adapted to receive a conventional wrench. Thus, the nozzle body may be readily attached to or detached from a spray gun body assembly.

Figure 4:
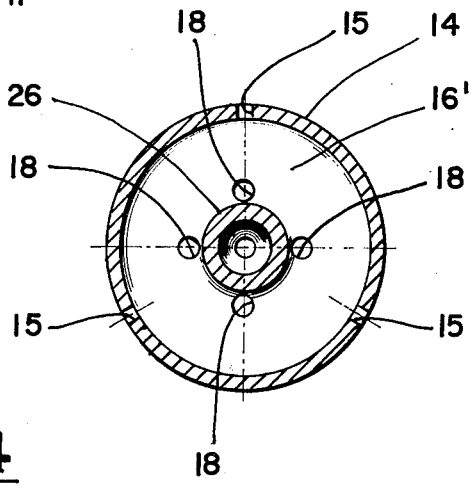
FIG. 4 is a cross-sectional view taken substantially along line 4—4 of FIG. 2 depicting components of the body portion of the nozzle.

Extending axially from the lands 13 of body portion 11 is a collar 14 which overlies at least a portion of the threaded bore 12 positioned inwardly within the body portion 11. As seen by a reference to FIGS. 1, 2 and 4, the collar 14 has a plurality of through ports 15. For exemplary purposes, FIG. 4 depicts three ports 15 substantially equally circumferentially disposed about the collar 14 for a purpose to be described hereinafter in detail.

Projecting axially outwardly from the collar 14 of body portion 11 is a shank 16 which may be of generally cylindrical configuration. The shank 16 preferably has threads 17 formed on a portion of the external surface thereof for a purpose to be hereinafter explained. Referring now particularly to FIGS. 1 and 4, the shank 16 has a plurality of through passages 18 which effect communication between the threaded bore 12 at the axially inner radial surface 16' of the shank 16 and the axially outer radial surface 16'' thereof. As shown, four circumferentially equally spaced through passages 18 are provided to effect the requisite quantitative flow of air, it being understood that an appropriate number and size of passages, are provided to satisfy the pressurized air requirements of a particular nozzle 10.

Extending from the axially outer radial surface 16'' of shank 16 is a cylindrical extension 20 which merges into a liquid dispensing tip 21. As shown, the liquid dispensing tip 21 is preferably in the form of a frustum of a cone for a purpose hereinafter detailed. The cylindrical extension 20 has, preferably proximate the liquid dispensing tip 21, a circumferential groove 22 which seats a toroidal sealing member 23 which may be a conventional elastomeric O-ring.

Projecting axially inwardly from the axially inwardly radial surface 16' of shank 16 is a liquid coupling flange 25 which may be seen in FIG. 1. The liquid coupling flange 25 may be offset from the surface 16' by an undercut extension 26. The liquid coupling flange 25 is appropriately positioned and configured for engagement with the liquid output of the gun body assembly of a spray gun to which the nozzle 10 is to be attached. As shown, the liquid coupling flange 25 has a beveled surface 27 for engaging a comparably beveled surface, sealing ring or other member of a spray gun body assembly (not shown).

Extending from the axially inner face of liquid coupling flange 25 is a liquid transmission channel 28 which extends through the shank 16, cylindrical extension 20 and liquid dispensing tip 21. Thus, liquid supplied from a spray gun body assembly passes entirely through the nozzle from end to end for controlled dispensing at the liquid dispensing tip 21. As shown, the liquid channel 28 may be of a slightly converging conical configuration progressing through the shank 16 from the axially inner portion to the axially outer portion, through the cylindrical extension 20, and through the liquid dispensing tip 21. For purposes of controlling the rate of discharge of liquid from the liquid dispensing tip 21 spray guns are commonly provided with a liquid control needle 30, depicted in chain lines by the numeral 30, which is axially movable to discharge liquid and may be adjusted for variably constricting the channel 28 in the area of liquid dispensing tip 21 by virtue of the absence or progressive entry of the needle 30 thereinto.

Besides the liquid supplied from a spray gun body assembly to the liquid coupling flange 25, compressed air is also supplied to the bore 12 of body portion 11 through apertures in a spray gun body assembly positioned radially outwardly of the spray gun liquid output which engages the liquid coupling flange 25. This pressurized air normally supplied from a conventional compressor passes from the bore 12 through the shank 16 of the body portion 11 via the through passages 18 therein.

The quantity of pressurized air transiting the through passages 18 may be controlled at the nozzle by an air adjusting sleeve, generally indicated by the numeral 35. The sleeve 35 has an internally threaded bore 36 which matingly engages the aforedescribed threads 17 formed on a portion of the external surface of the shank 16. The sleeve 35 has an axially inwardly projecting annular flange 37 forming an inner surface 38 which, as seen in FIG. 1, is adapted to substantially matingly overlie the collar 14 of the body portion 11. The sleeve 35 may, in a manner comparable to the body portion 11, be provided with a plurality of lands 39 formed externally thereof for purposes of creating a standard hexagonal or other head configuration adapted to receive a conventional wrench. The sleeve 35 may thus be rotated from the position depicted in FIG. 1 wherein the through ports 15 are open to the atmosphere to permit a quantitative maximum relief or escape of air within the bore 12 to a partial or total blockage of the ports 15 as the inner surface 38 of flange 37 proceeds axially inwardly across the through ports 15 to a position proximate the lands 13 of body portion 11. In this manner it is possible to provide fine control of the quantity of air supplied through the passages 18 or to appropriately compensate for a spray gun body assembly which does not have quantitative air supply control.

Pressurized air is controllably dispelled from the nozzle 10 by an air dispensing assembly, generally indicated by the numeral 45. The air dispensing assembly includes an air cap adjustment ring 46 which overfits a portion of the shank 16 located axially outwardly of the threads 17 thereon. The air cap adjustment ring 46 is nonrotatably affixed to the shank 16 as by a set screw 47 or other comparable securing device. The adjustment ring 46 has threads 48 over at least a portion of the external surface thereof for purposes of receiving an air cap 50 which is selectively positioned in relation thereto.

As seen in FIGS. 1 and 2 the air cap 50 has a radial face plate 51 with an axial flange 52 having at least an internal portion thereof spaced from the face plate 51 provided with threads 53 for mating engagement with the threads 48 of air cap adjustment ring 46 to permit selective axial positioning of the air cap 50 relative to the air cap adjustment ring 46 and thusly the body of the nozzle 10. In this manner an annular air chamber is formed by the radial face plate 51 and axial flange 52 of the air cap 50 together with the cylindrical extension 20 and the axially outer radial face 16" of the shank 16 of the body portion 11. The air chamber thus defined is supplied with pressurized air from the through passages 18 disposed on the axially outer radial surface 16" of shank 16 and is of variable axial extent by virtue of the selective axial positioning of the air cap 50 relative to air cap adjustment ring 46 and the components of body portion 11. In order to facilitate rotation of air cap 50 to select a desired extent of engagement between threads 53 of the axial flange 52 of the air cap 50 relative to the threads 48 of the air cap adjustment ring 46, a portion of the external surface of axial flange 52 of air cap 50 may be provided with a knurled surface 54 for purposes of facilitating manual gripping and rotation.

Figure 3:
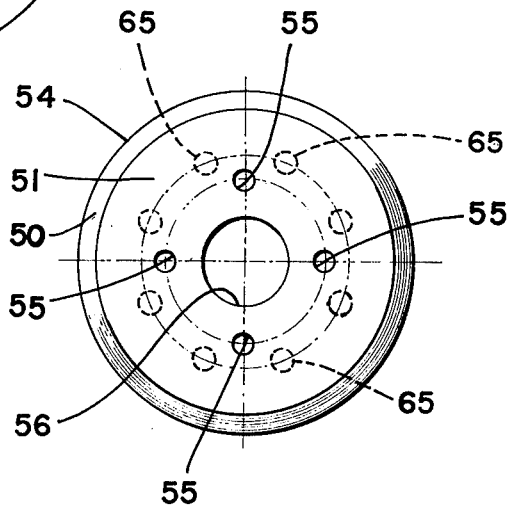
FIG. 3 is a top plan view taken substantially along line 3—3 of FIG. 2 of the face portion of the air cap.

The air chamber communicates outwardly of nozzle 10 by virtue of orifices 55 positioned in the face plate 51 of the air cap 50. As seen in FIGS. 1 and 3, a plurality of orifices 55 may be provided in the face plate 51 disposed circumferentially about the projecting dispensing tip 21 of the body portion 11 to provide a plurality of air jets dispensing pressurized air substantially axially outwardly of the nozzle 10. It has been emperically determined that four substantially equally circumferentially spaced orifices 55 provide suitable operating characteristics according to the present invention. In this respect, four orifices having a diameter of approximately 0.05 of an inch providing a combined cross-sectional area on the order of approximately 0.007 square inches to 0.01 square inches affords suitable operating characteristics for a conventional pressurized air source delivering on the order of two and one-half to five cubic feet per minute at fifteen to fifty pounds per square inch at a nozzle. It is to be appreciated that a configuration having a greater number of substantially equally circumferentially spaced orifices 55 of somewhat lesser diameters but providing comparable total cross-sectional area could provide equivalent operational characteristics. In the event of an air source of differing characteristics suitable adjustment in the size and number of the orifices 55 may be operationally advantageous.

In addition to the orifices 55 which continually dispense air during operation of the nozzle 10, the air cap 50 has an aperture 56 disposed substantially centrally of the face plate 51 of air cap 50 and radially inwardly of the orifices 55. A portion of the aperture 56 in face plate 51 is preferably a beveled surface 57 which may advantageously parallel the conical side of liquid dispensing tip 21. Both the conical side of the dispensing tip 21 and the beveled surface 57 may be angularly offset from the axis of the nozzle 21 through an angle $\beta$ of approximately 30°. As may be appreciated by reference to FIG. 1, the axially outward displacement of air cap 51 relative to the dispensing tip 21 produces an annular air curtain around the liquid dispensing tip 21 of enlarging radial dimension while concurrently reducing the quantity of air dispensed from the orifices 55. As the air cap 50 is rotated to produce axially inward displacement the radial dimension of the annular air curtain is reduced until the sealing member 23 on cylindrical extension 20 of the body portion 11 engages the beveled surface 57 of air cap 50. When the air cap 50 is thus seated against the annular sealing member 23 the annular air curtain is totally throttled and the totality of the air supplied to the air chamber formed within air cap 50 is directed through the orifices 55 in the form of air jets. It is to be appreciated that an extent of deviation in the angle $\beta$ may be effected while retaining the variable annular air curtain characteristics herein described.

Due to the substantially axially outward orientation of orifices 55 of air cap 50 and the deviation from axial directivity of the annular air curtain, when present, the liquid emitted from the liquid dispensing tip 21 is generally entrained within one or both of these air sources during transmittal for purposes of controlled disposition on a work surface. The absence of the very fine atomization of the liquid produced by the severely intersecting air currents of conventional internal or external mix nozzles reduces both the tendencies of the liquid to drift uncontrollably beyond the air jet pattern and to rebound from a work surface. For producing a speckled or intermittent splatter effect the air cap 50 is normally positioned proximate its maximum axially inward displacement such that there is a minimum or no annular air curtain. When a more uniform surface coverage is desired, a more pronounced annular air curtain is provided by adjusting air cap 50 axially outwardly, thereby concomitantly reducing somewhat the quantitative output from the orifices 55. In this latter instance, the intersection of the air jets from the orifices 55 and the annular air curtain produces a variable finer atomization than is present with the air jets alone; however, the avoidance of the very fine atomization of conventional nozzles eliminates the operational problems associated therewith which are described hereinabove.

Once operatively positioned the air cap 50 and air adjusting sleeve 35 are restrained from accidental movement during operation of the nozzle 10 on a spray gun which would alter selected settings thereof by air cap and air adjusting sleeve retainer assemblies, generally indicated by the numeral 60 in FIGS. 1 and 2. As shown, each air cap and air adjusting sleeve retainer assembly 60 has an air cap engaging ball 61 and air adjusting sleeve engaging ball 62. The engaging balls 61 and 62 are radially restrained and biased into contact with the air cap 50 and the air adjusting sleeve 35, respectively, by a compression spring 63 interposed therebetween. As shown, the springs 63 are housed in bores 64 in the air cap adjustment ring 46. Although more or less retainer assemblies might be employed, the diametrically opposed positioning of the two assemblies depicted together with the biased ball members 61 and 62 provide sufficiently balanced forces on the air cap 50 and the air adjusting sleeve 35.

Although the force on cap 50 and sleeve 35 afforded by the balls 61 and 62, respectively, may be sufficient to restrain inadvertent rotation thereof, the axially inner surface of face plate 51 of air cap 50 and the axially outer surface of the sleeve 35 which are engaged by balls 61 and 62, respectively, may be provided with a plurality of detents 65 and 66, respectively, (FIG. 3) circumferentially spaced about a circle having a diameter equivalent to the distance between the retainer assemblies 60. As see in FIG. 3, eight substantially equally circumferentially spaced detents afford sufficient adjustment in thus providing eight locking positions per revolution of the cap 50 on the sleeve 35; however, depending upon the characteristics of the threads 17 of the shank 16 and the threads 48 of the air cap adjustment ring 46 more or fewer detents could be provided to effect the desired incremental control of the axial positioning of air cap 50 with respect to liquid dispensing tip 21 and air adjustment sleeve 35 with respect to the through ports 15.

We claim:

1. A nozzle for a spray gun for depositing liquid on a work surface comprising, body means having a channel communicating with a dispensing tip for the liquid, means for attaching said body means to the spray gun such that the liquid supplied from the spray gun is introduced into said channel of said body means, passage means for the transmittal of pressurized air from the spray gun to a position proximate said dispensing tip, air cap means circumposed about said dispensing tip, a plurality of orifices in said air cap means disposed circumferentially of said dispensing tip and communicating with said passage means for directing pressurized air jets axially of said air cap means, aperture means in said air cap means through which said dispensing tip extends axially outwardly of said orifices of said air cap means, means for spacing said aperture means relative to said dispensing tip of said body means to produce an annular air curtain radially inwardly of said orifices, whereby the liquid emitted from said dispensing tip is entrained within the confines of the pressurized air jets and deposited on the work surface.

2. A nozzle according to claim 1 wherein said dispensing tip is of a generally conical configuration and said air cap means is selectively positionable axially of said dispensing tip for varying the spacing between said aperture means and said dispensing tip thereby varying the radial size of the annular air curtain.

3. Apparatus according to claim 2 wherein said aperture means has a beveled surface paralleling the conical configuration of said dispensing tip such that said annular air curtain intersects the axial air jets of said air cap means.

4. A nozzle according to claim 2 including means for retaining said air cap means at a selected position axially of said dispensing tip.

5. A nozzle according to claim 4 wherein said means for retaining said air cap means at a selected position axially of said dispensing tip includes spring loaded ball means selectively engaging detents in said air cap means.

6. A nozzle according to claim 1, wherein said orifices extend substantially axially through said air cap means.

7. A nozzle according to claim 6, wherein said dispensing tip is conical and carries sealing means for selectively engaging said aperture means in said air cap means.

8. Apparatus according to claim 7, including means for displacing said air cap means relative to said dispensing tip to control the radial dimension of the annular air curtain.

9. A nozzle for a spray gun for depositing liquid on a work surface comprising, body means having a channel communicating with a dispensing tip for the liquid, means for attaching said body means to the spray gun such that the liquid supplied from the spray gun is introduced into said channel of said body means, passage means for the transmittal of pressurized air from the spray gun to a position proximate said dispensing tip, air cap means circumposed about said dispensing tip, a plurality of orifices in said air cap means communicating with said passage means for directing pressurized air jets axially of said air cap means, whereby the liquid emitted from said dispensing tip is entrained within the confines of the pressurized air jets and deposited on the work surface, and port means in said body means for controlling the quantity of pressurized air transmitted through said passage means and said orifices of said air cap means.

10. A nozzle according to claim 9 including sleeve means movable axially of said body means for selectively blocking said port means.

11. A nozzle according to claim 10 including means for retaining said sleeve means at a selected position axially of said body means.

* * * * *